US010408015B2

(12) United States Patent
Adam

(10) Patent No.: US 10,408,015 B2
(45) Date of Patent: Sep. 10, 2019

(54) COMBINATION BOTTOM UP AND TOP DOWN CEMENTING WITH REDUCED TIME TO SET LINER HANGER/PACKER AFTER TOP DOWN CEMENTING

(71) Applicant: Baker Hughes, a GE company, LLC, Houston, TX (US)

(72) Inventor: Mark K. Adam, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 103 days.

(21) Appl. No.: 15/657,986

(22) Filed: Jul. 24, 2017

(65) Prior Publication Data

US 2019/0024476 A1 Jan. 24, 2019

(51) Int. Cl.

| | |
|---|---|
| ***E21B 33/16*** | (2006.01) |
| ***E21B 33/14*** | (2006.01) |
| ***E21B 33/12*** | (2006.01) |
| ***E21B 23/06*** | (2006.01) |
| ***E21B 43/10*** | (2006.01) |

(52) U.S. Cl.

CPC ..... *E21B 33/14* (2013.01); *E21B 23/06* (2013.01); *E21B 33/1208* (2013.01); *E21B 33/16* (2013.01); *E21B 43/10* (2013.01)

(58) Field of Classification Search

CPC ..... E21B 33/13; E21B 33/14; E21B 33/16

See application file for complete search history.

(56) References Cited

U.S. PATENT DOCUMENTS

| | | | | |
|---|---|---|---|---|
| 3,006,415 | A * | 10/1961 | Burns et al. | E21B 33/16 166/156 |
| 3,730,267 | A * | 5/1973 | Scott | E21B 33/146 166/154 |
| 6,923,255 | B2 | 8/2005 | Lee | |
| 7,337,840 | B2 | 3/2008 | Penno | |
| 8,387,693 | B2 | 3/2013 | Tunget | |
| 9,410,399 | B2 * | 8/2016 | Andersen | E21B 34/14 |
| 9,611,722 | B2 | 4/2017 | Hern et al. | |
| 2008/0149336 | A1 * | 6/2008 | Szarka | E21B 33/146 166/291 |
| 2008/0251253 | A1 * | 10/2008 | Lumbye | E21B 33/16 166/285 |
| 2010/0155067 | A1 | 6/2010 | Tunget | |
| 2013/0092375 | A1 * | 4/2013 | Melenyzer | E21B 33/05 166/281 |

(Continued)

*Primary Examiner* — Kenneth L Thompson

(74) *Attorney, Agent, or Firm* — Shawn Hunter

(57) ABSTRACT

A liner is cemented bottom up and then top down followed by setting the simultaneously set liner hanger/packer and releasing the running tool. In one embodiment the ported sub for top down cementing has ports opened and then closed with multiple dropped or pumped balls one of which lands in the running tool to set the hanger packer with pressure before running tool removal. A dart with a leading ball can follow the top down cement to close the ported sub and thereafter land in the liner hanger/packer to set it with pressure. A dart can lead the top down cement and open the ported sub followed by a second dart behind the top down cement to close the ported sub and land in the liner hanger/packer to set it and to release the running tool. The ported sub can be operated in other ways such as motors responsive to a remote signal.

17 Claims, 15 Drawing Sheets

(56) References Cited

U.S. PATENT DOCUMENTS

| | | | | |
|---|---|---|---|---|
| 2013/0118752 | A1* | 5/2013 | Hannegan | E21B 47/0005 166/336 |
| 2016/0121378 | A1 | 5/2016 | Antal et al. | |
| 2016/0281459 | A1 | 9/2016 | Stautzenberger et al. | |
| 2017/0081943 | A1* | 3/2017 | Hansen | E21B 33/13 |
| 2018/0135378 | A1* | 5/2018 | Budde | E21B 23/04 |

* cited by examiner

COMBINATION BOTTOM UP AND TOP DOWN CEMENTING WITH REDUCED TIME TO SET LINER HANGER/PACKER AFTER TOP DOWN CEMENTING

FIELD OF THE INVENTION

The field of the invention is cementing a liner bottom up and then top down and reducing time between the conclusion of top down cementing and setting the liner hanger/packer and releasing a running tool.

BACKGROUND OF THE INVENTION

Traditional liner cementing involves delivery of cement through a liner that is hung off casing with the cement going through a cement shoe at the lower end of the liner and back around in the annular space around the suspended liner. Fluid is displaced by the advancing cement through the liner hanger. At the time of fluid displacement with cement, the seal on the liner hanger is not set and there are gaps between the anchor slips through which the displaced fluid moves. After the cement is delivered a trailing wiper plug is released to clear the liner of excess cement. The liner shoe has a check valve to prevent return of the cement. The seal on the liner top packer is then set and the liner running tool is pulled out of the hole. The shoe can be milled or drilled out and more hole can then be drilled and the process can be repeated.

In some situations there can be doubt that the cement is adequately distributed using this method and an alternative technique for cement placement is desired. This is particularly beneficial when a formation is particularly weak which can result in significant fluid loses due to low fracture gradients.

Cementing bottom up and then top down presents a challenge when the liner hanger/packer is designed such that the slips and packing element are set simultaneously. This simultaneously set hanger/packer cannot be set until the top down cementing is over. To accomplish the sequence of bottom up and then top down the ports for top down cementing have to be closed for initial displacement of the bottom up cement job, then opened for the top down cement job and finally reclosed so that pressure can be applied to set the liner hanger/packer. This operation can entail, in one instance, waiting for a ball to drop to a seat to close a cementing port and then further object displacement to close off the running string at the liner hanger/packer so that pressure can be applied to set the liner hanger/packer. The running tool still needs to be released from the liner hanger packer after the set so time is of the essence to be sure the running tool can still be released after setting the liner hanger/packer with cement potentially surrounding the tools. The most significant and feared non-productive time event in running liners is generally considered to be cementing running tools in the hole. For that reason, techniques are presented that shorten the time from the conclusion of the top down cementing to the setting of the liner hanger/packer and release of the running tool from the set liner hanger/packer. Those skilled in the art will appreciate these and additional aspects of the present invention from a review of the description of the preferred embodiments and the associated drawings while recognizing that the full scope of the invention is to be found in the appended claims.

SUMMARY OF THE INVENTION

A liner is cemented bottom up and then top down followed by setting the simultaneously set liner hanger/packer and releasing the running tool. In one embodiment the ported sub for top down cementing has ports opened and then closed with multiple dropped or pumped balls one of which lands in the running tool to set the hanger packer with pressure before running tool removal. A dart with a leading ball can follow the top down cement to close the ported sub and thereafter land in the liner hanger/packer to set it with pressure. A dart can lead the top down cement and open the ported sub followed by a second dart behind the top down cement to close the ported sub and land in the liner hanger/packer to set it and to release the running tool. The ported sub can be operated in other ways such as motors responsive to a remote signal.

DETAILED DESCRIPTION OF THE PREFERRED EMBODIMENT

Figure 1:
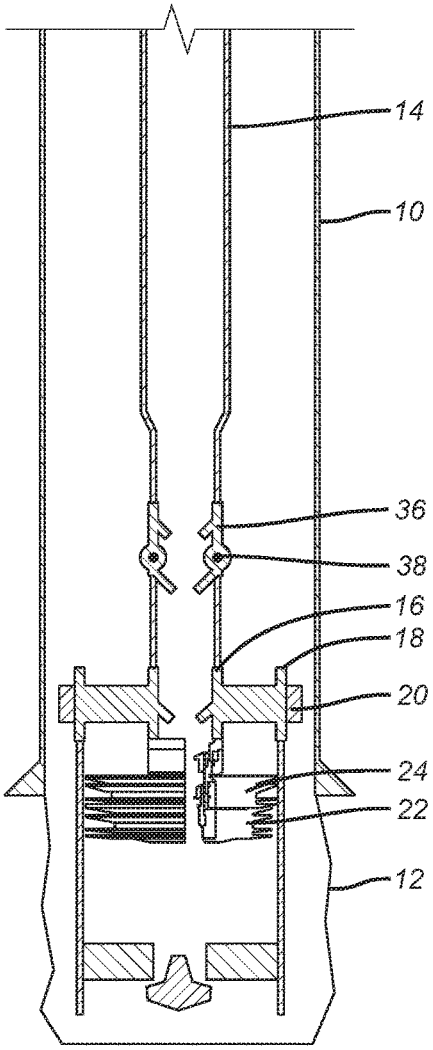
FIG. 1 is a schematic representation of a bottom up and then top down cementing operation followed by setting the liner hanger/packer with dropped balls showing the run in position.
Figure 2:
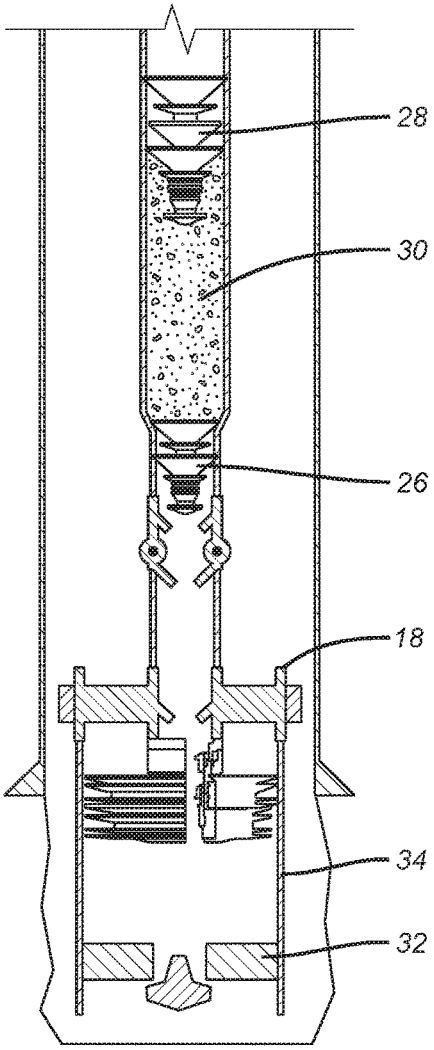
FIG. 2 is the view of FIG. 1 showing the bottom up cement delivered.
Figure 3:
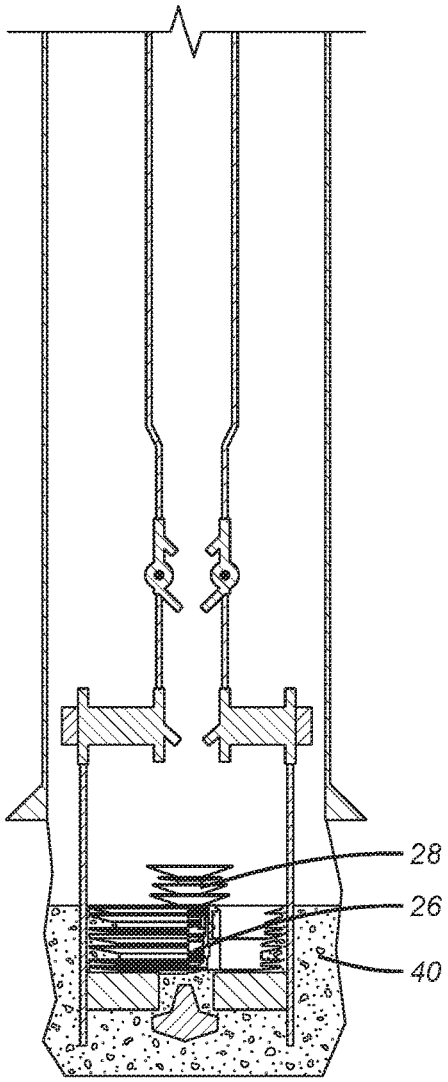
FIG. 3 is the view of FIG. 2 showing the plugs bumped and the bottom up cement in the annulus.

Referring to FIG. 1, casing 10 is in borehole 12 and a running string 14 delivers a running tool 16 attached to a liner hanger/packer 18. The sealing element and slips on the liner hanger/packer 18 are represented schematically as 20 and are shown in the unset position for running in. The running tool 16 supports a lower wiper plug 22 and an upper wiper plug 24 that are launched when darts 26 and 28 respectively land in them, as shown in FIGS. 2 and 3. A measured quantity of cement or other sealant 30 is introduced into the running tool string 14 with a leading dart 26 and a trailing dart 28. A float valve 32 is at the lower end of the liner 34 supported by the liner hanger/packer 18. The running string 14 further comprises a ported sub assembly 36 that includes ports 38 shown closed in FIGS. 1-3. The leading dart 26 passes through the ported sub assembly 36 with the cement 30 behind it and the trailing dart 28 behind the cement 30. The leading dart 26 lands in wiper plug 22 to release wiper 22 from the running tool 16 so that the wiper plug 22 moves until bumped near the float shoe 32 at which point a flow passage is opened through the dart 26 or plug 22 so that the cement 30 can pass through the float shoe 32 as the trailing dart 28 advances to the trailing wiper plug 24. The dart 28 lands in the trailing wiper plug 24 to push all the cement 30 through the float shoe 32. The trailing wiper plug 24 is then bumped near the float shoe 32 as the cement 30 passes through the float shoe 32 and into annulus 40, as shown in FIG. 3. The bottom up cementing operation is concluded at this time. The upper plug 24/dart 28 combination is not configured to bypass flow once bumped.

Figure 4:
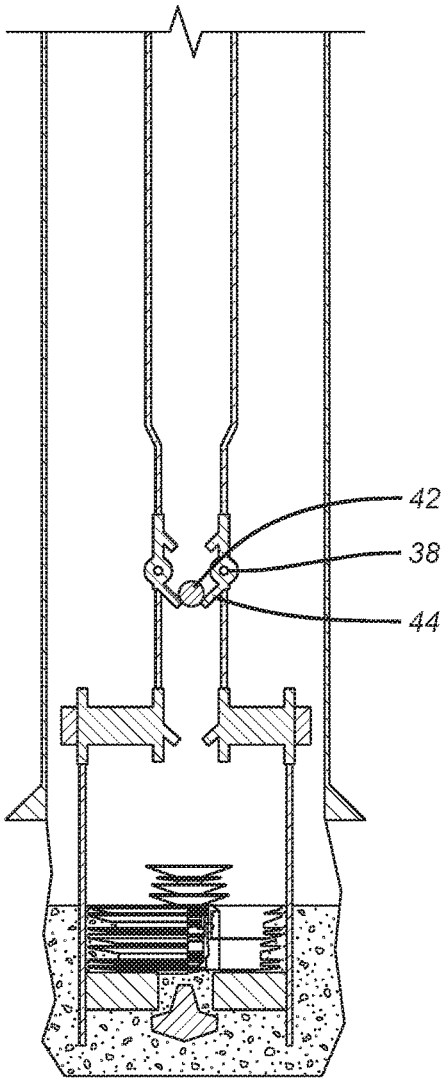
FIG. 4 is the view of FIG. 3 with a first ball dropped to open a ported sub above the liner hanger/packer.
Figure 5:
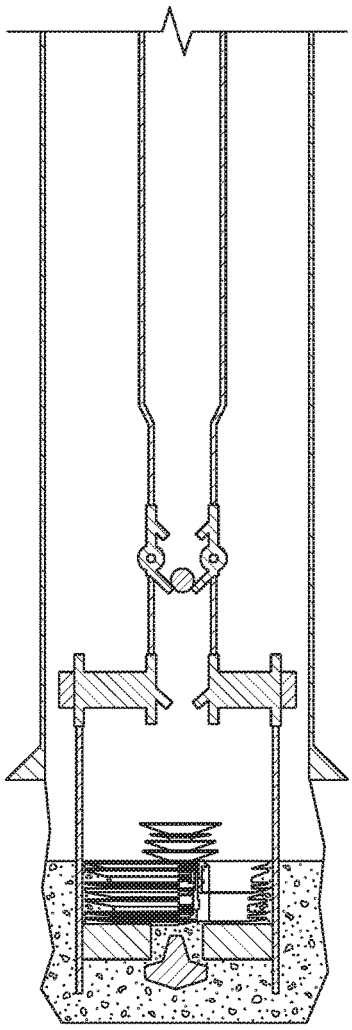
FIG. 5 is the view of FIG. 4 with the first ball displaced to a lower seat and the side ports opened.

As shown in FIG. 4 a ball 42 is dropped to land in lower seat attached to an opening sleeve 44 of the ported sub 36 and pressure is applied against seated ball 42 to open the ports 38 as shown in FIG. 5. The ball 42 can stay on seat 44 with the ports 38 open and surface personnel can observe returns at the surface from open ports 38 to know that the top down cementing operation can begin. Alternatively, further pressure can be applied to displace ball 42 from ported sub 36 or to capture the ball 42 out of a main flowpath of ported sub 36 so that subsequent objects can pass as will be explained below.

Figure 6:
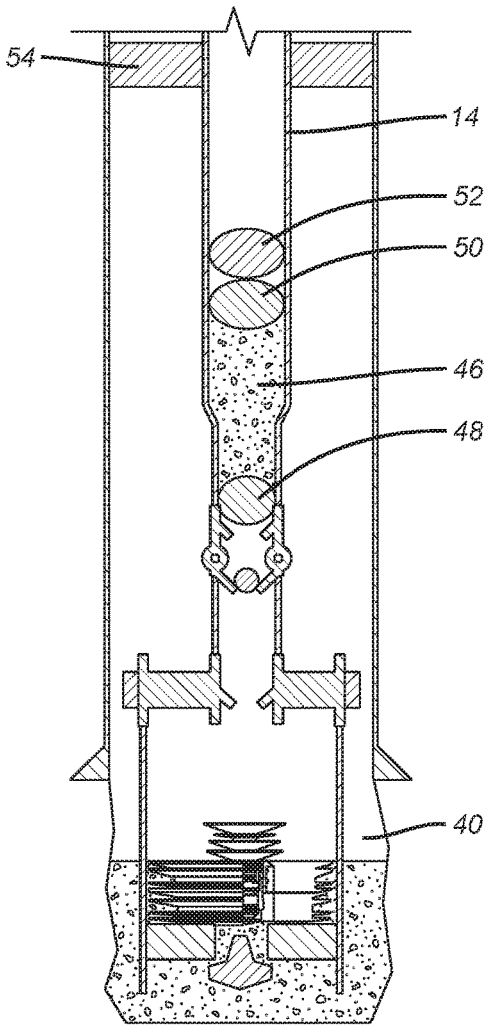
FIG. 6 is the view of FIG. 5 with the top down cement delivered between foam balls.

FIG. 6 shows the top down cement 46 led by foam ball 48 and with foam balls 50 and 52 trailing behind. Different numbers of foam balls can be used or other devices to isolate the cement 46 from well fluids in the running string 14 within the spirit of the invention. The well's annular preventer 54 is closed to force the cement flow towards the weak formation. The liner hanger/packer's sealing element and slips 20 are still not set. The foam plugs 48, 50 and 52 are optional and the cement 46 can be delivered for squeezing into annulus 40 without leading and trailing barriers.

Figure 7:
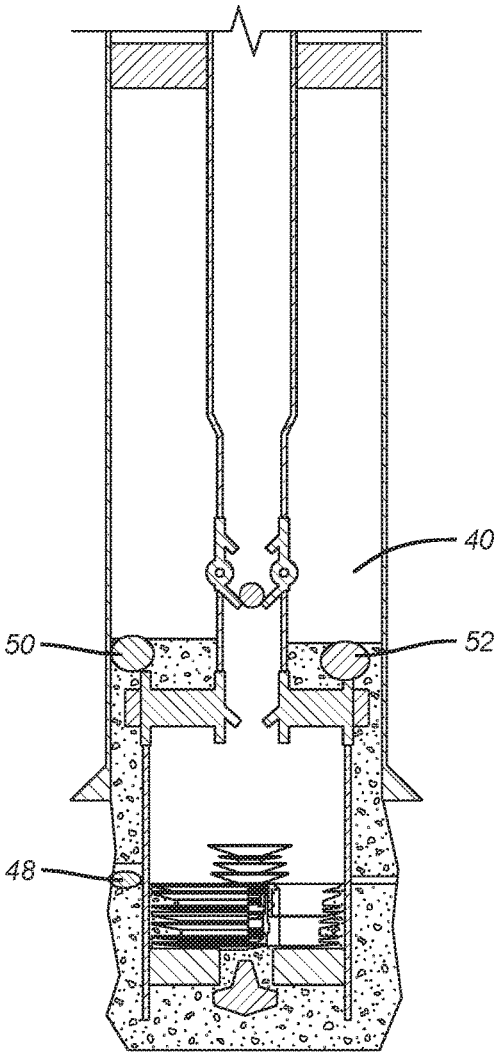
FIG. 7 is the view of FIG. 6 with the top down cement and the foam balls in the annulus.

FIG. 7 shows the cement 46 in the annulus 40 with the optional foam balls 48, 50 and 52. Here again the slips and sealing element 20 are not yet set and the cement 46 is injected into the annulus 40. This is a squeeze operation that will push any well fluid ahead of cement 46 into the formation along with possibly some of the cement 46. There are no returns to the surface during the squeeze operation.

Figure 8:
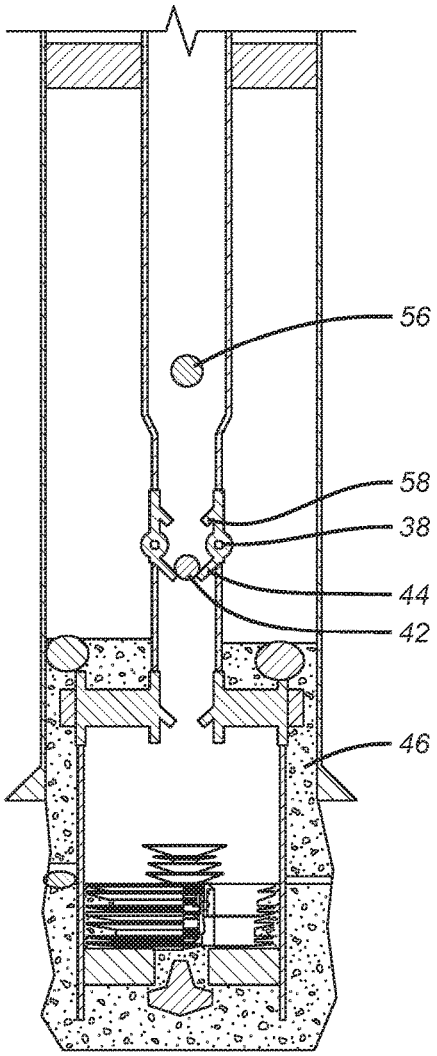
FIG. 8 is the view of FIG. 7 with a second ball dropped.
Figure 9:
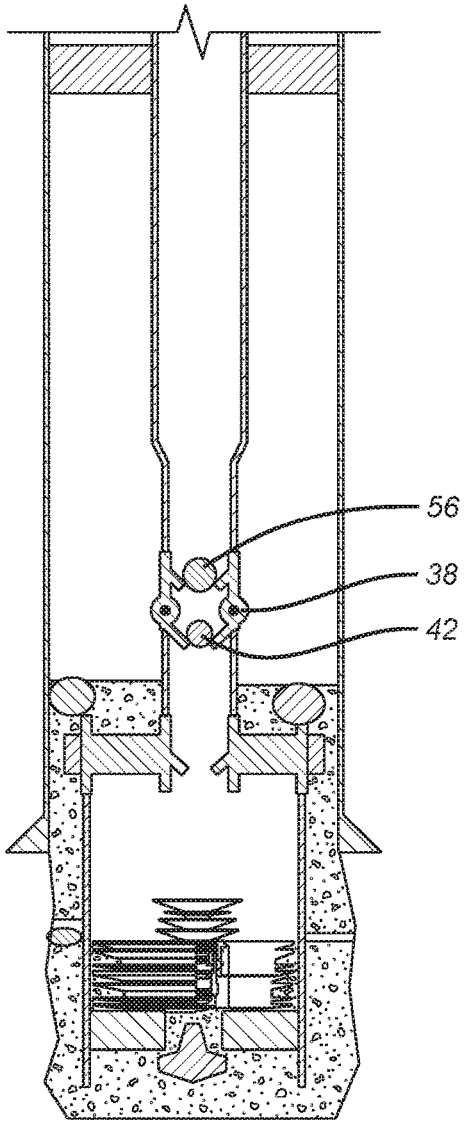
FIG. 9 is the view of FIG. 8 with the second ball landed on a top seat in the ported sub.
Figure 10:
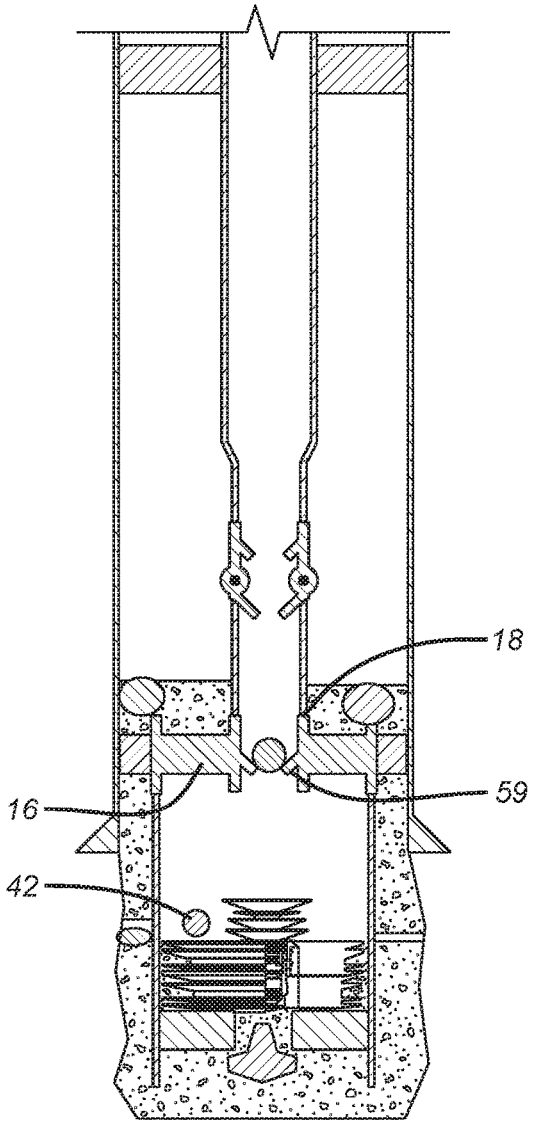
FIG. 10 is the view of FIG. 9 with the ported sub closed and the second ball displaced onto the liner hanger/packer and the liner hanger/packer set.
Figure 11:
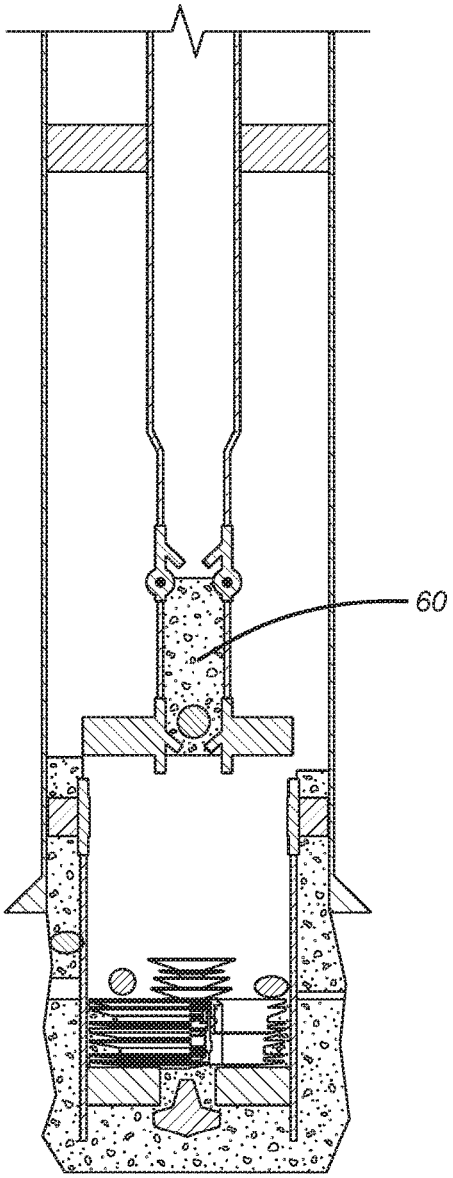
FIG. 11 is the view of FIG. 10 with the running tool removed from the liner hanger/packer and cement reversed out.
Figure 12:
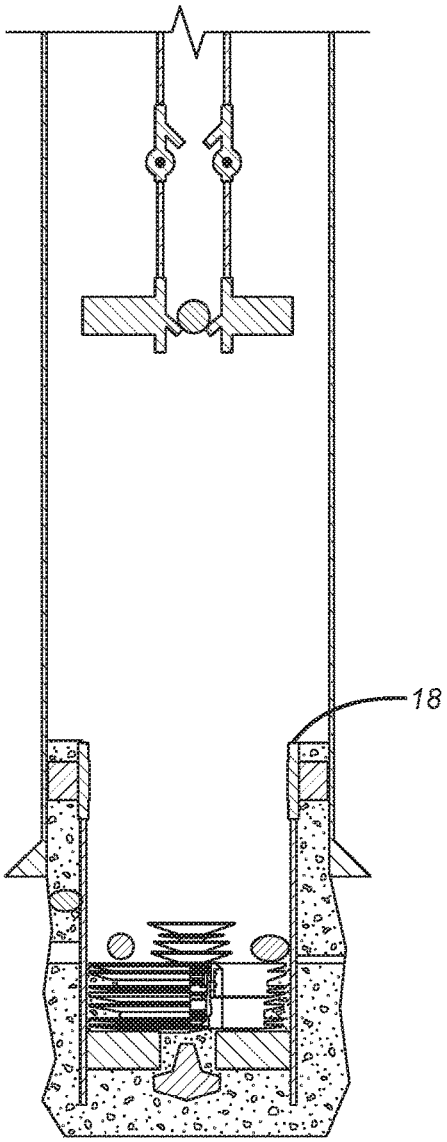
FIG. 12 is the view of FIG. 11 with the running tool coming out of the hole.
Figure 13:
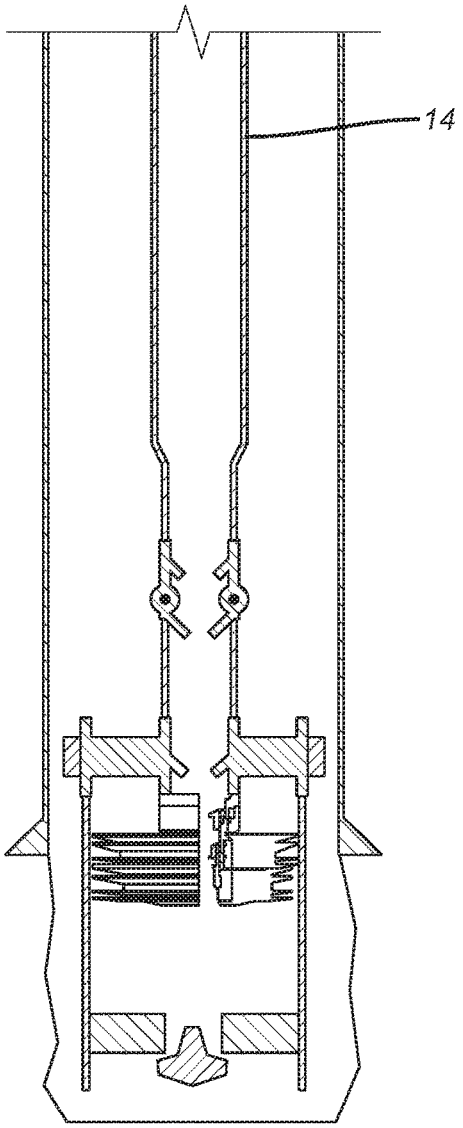
FIG. 13 is a run in view of a system of bottom up and then top down cementing using a ball attached to a dart behind the top down cement.
Figure 14:
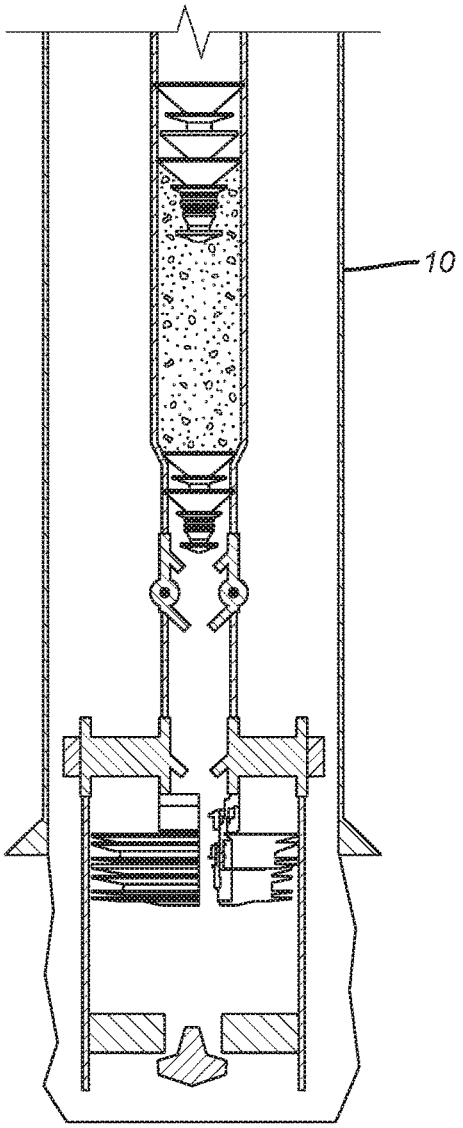
FIG. 14 is the view of FIG. 13 showing the bottom up cement delivered.
Figure 15:
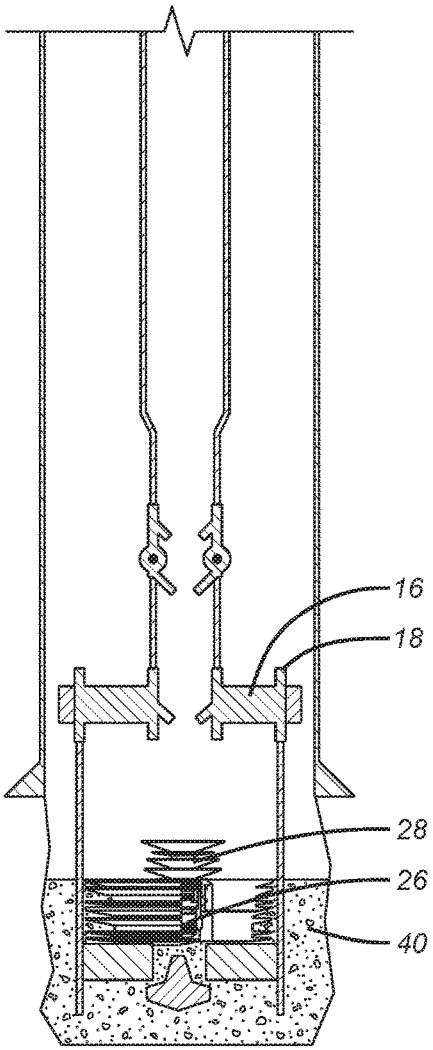
FIG. 15 is the view of FIG. 14 with the bottom up cement displaced and the plugs bumped.
Figure 16:
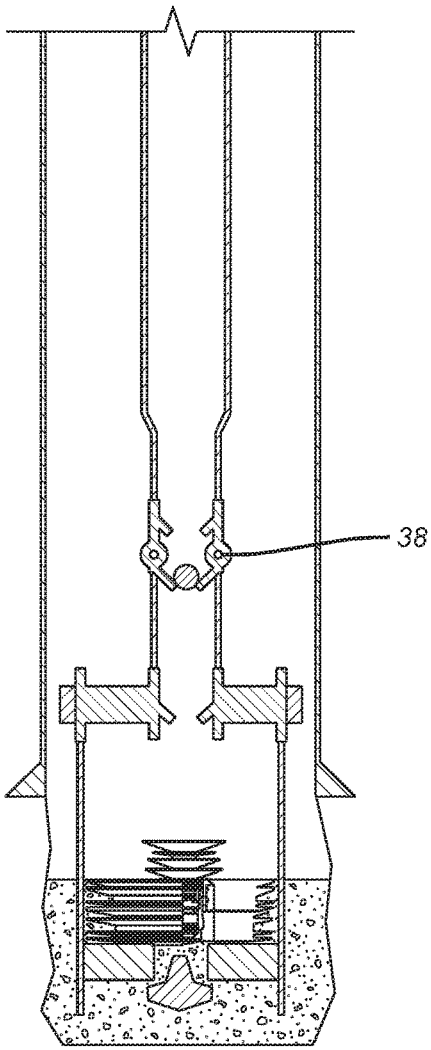
FIG. 16 is the view of FIG. 15 with a first ball delivered to the ported sub seat.
Figure 17:
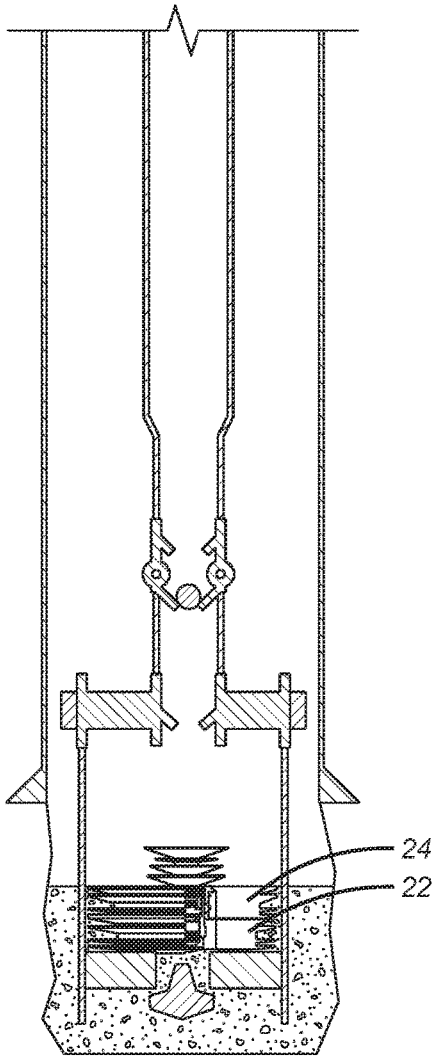
FIG. 17 is the view of FIG. 16 with a landed ball on the ported sub to open the lateral ports.
Figure 18:
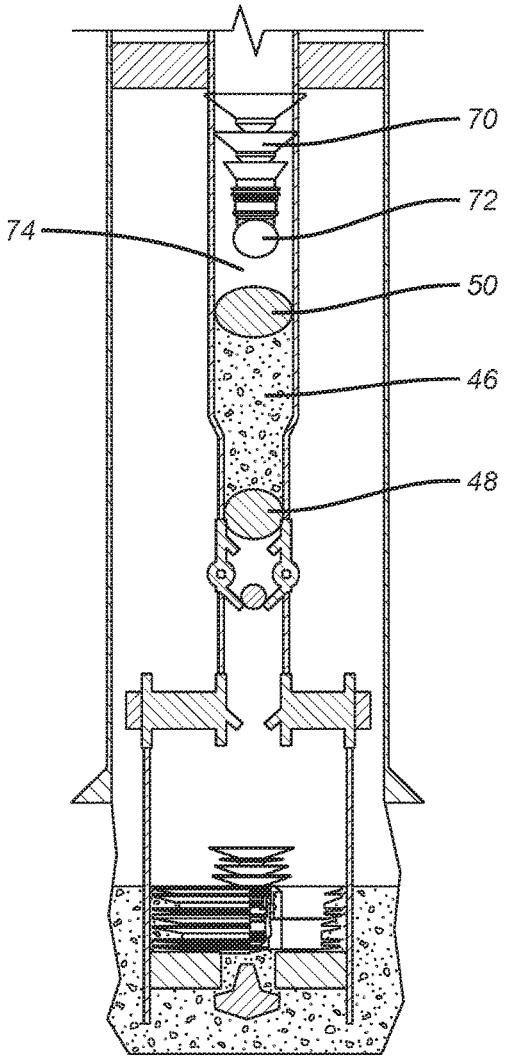
FIG. 18 is the view of FIG. 17 with the top down cement being delivered.
Figure 19:
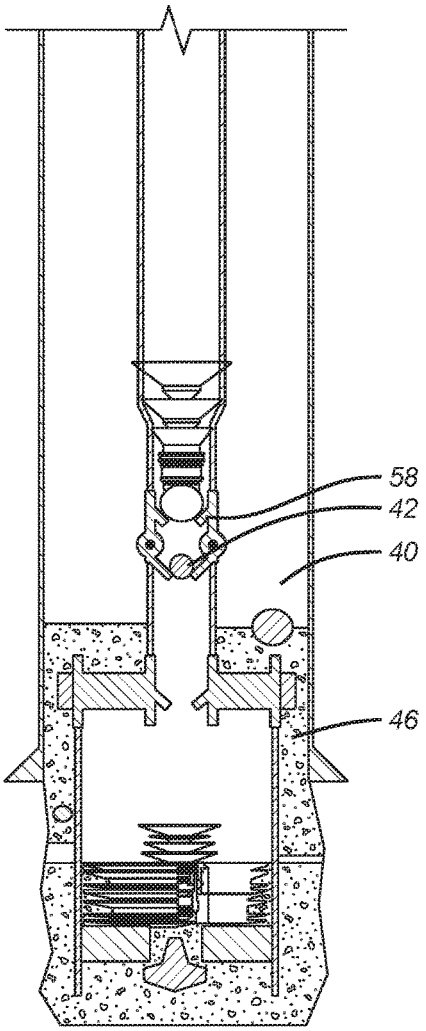
FIG. 19 is the view of FIG. 18 with the dart with a leading ball that came down with the top down cement landed in the ported sub.

In FIG. 8 a second ball 56 is dropped to land on closing seat attached to a closing sleeve 58. Ball 42 remains on seat 44. Ball 56 is larger than ball 42 and the cement 46 has preferably not set up when ball 56 is delivered to close the ports 38 as shown in FIG. 9. Both balls 42 and 56 get blown through seats 44 and 58 and ball 56 lands in seat 59 of the running tool 16 where pressure can then be built up to set the liner hanger/packer 18 shown in FIG. 10. Ports 38 get closed in FIG. 9 with pressure on seated ball 56 after which ball 56 is blown onto seat 59 for setting the liner hanger/packer 18. At this time either the slips of the liner hanger/packer 18 can be set or both the slips and sealing element 20 can be set together. The running tool 16 is pressure released from the liner hanger/packer 18 at this point as shown in FIG. 11. Excess cement 60 is reversed out and the running tool 16 is pulled out of the hole as shown in FIG. 12. The liner hanger/packer 18 remains and further completion operations or more drilling can then be pursued.

One concern in the method described above is that it could take a very long time to land ball 56 during which time the cement 46 could set up making it risky for the subsequent intended release of the running tool 16 from the liner hanger/packer 18. If the cement 46 sets up above the running tool 16 the running tool may stick forcing an abandonment of the completion and a need to drill a lateral after an expensive milling operation. What will next be explored are alternative ways to shorten this time between the completion of the squeeze cementing through the ported sub 36 and the time the liner hanger/packer 18 is set and the running tool 16 is automatically released from it.

Figure 20:
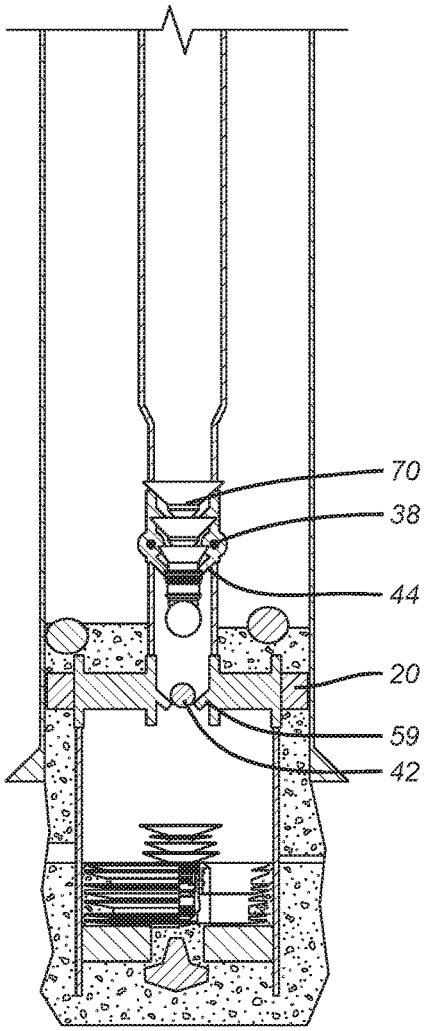
FIG. 20 is the view of FIG. 19 with the ports in the ported sub closed by the dart and the first ball landed in the liner hanger/packer to pressure set it.
Figure 21:
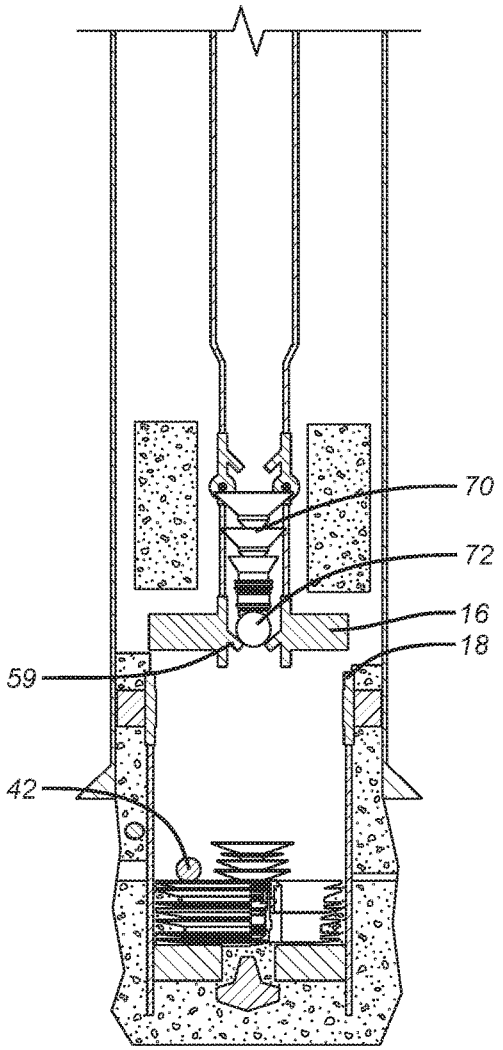
FIG. 21 is the view of FIG. 20 with the first ball blown through the ported sub and the wiper shifted into the liner hanger/packer for reversing out excess cement after the running tool releases the liner hanger/packer.
Figure 22:
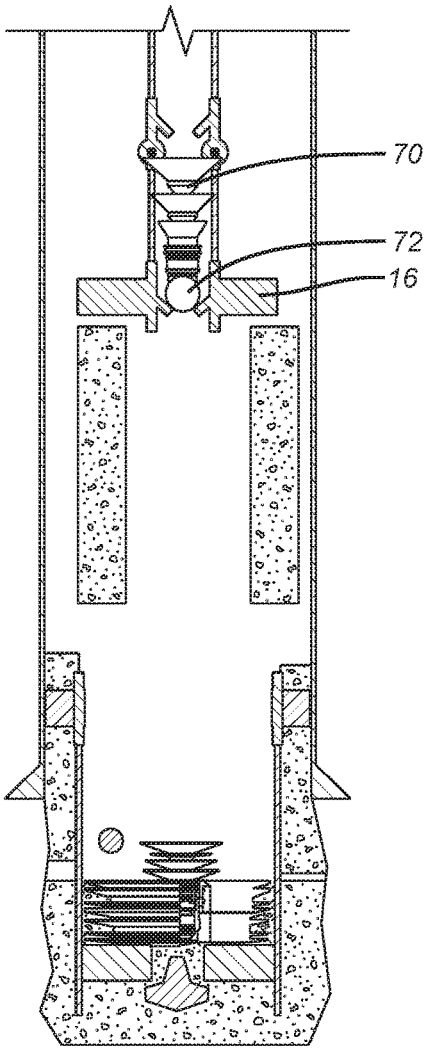
FIG. 22 is the view of FIG. 21 with the running tool pulling g out of the hole.

FIGS. 13-17 are identical to FIGS. 1-5 and FIG. 18 differs from FIG. 6 in that a dart 70 with an attached leading ball 72 is located behind a fluid spacer 74 and behind the cement 46 this time flanked by foam balls 48 and 50 although as before differing amounts of foam balls or no foam balls are another option. The leading ball 72 lands in seat 58 after cement 46 has passed into annular space 40. This means that as soon as the cement 46 is squeezed into annulus 40 pressure can be boosted again to force ports 38 to close as dart 70 advances as shown in FIG. 20 pushing ball 42 off seat 44 to land on seat 59 of the running tool 16. The liner hanger/packer 18 is now set as shown in FIG. 20 with the slips and seal 20 extended. As stated before the slips may be set first or both the slips and sealing element collectively represented as 20 can be set together. FIG. 21 shows ball 42 falling through seat 59 as the dart 70 advances further to the point where leading ball 72 lands on seat 59. The setting of the liner hanger/packer 18 release of the running tool 16 and retrieval of the running tool 16 in FIG. 22 with dart 70 and leading ball 72.

Figure 23:
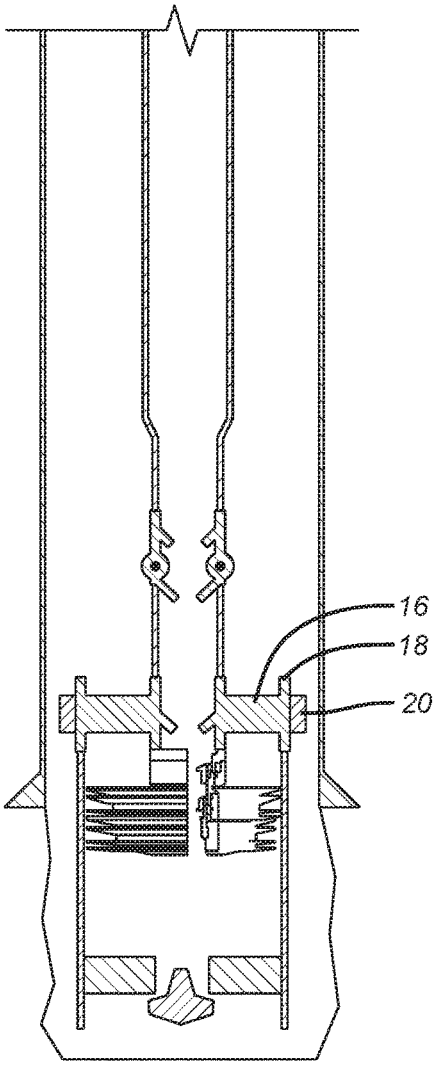
FIG. 23 is a run in position of a bottom up and then top down cementing assembly.
Figure 24:
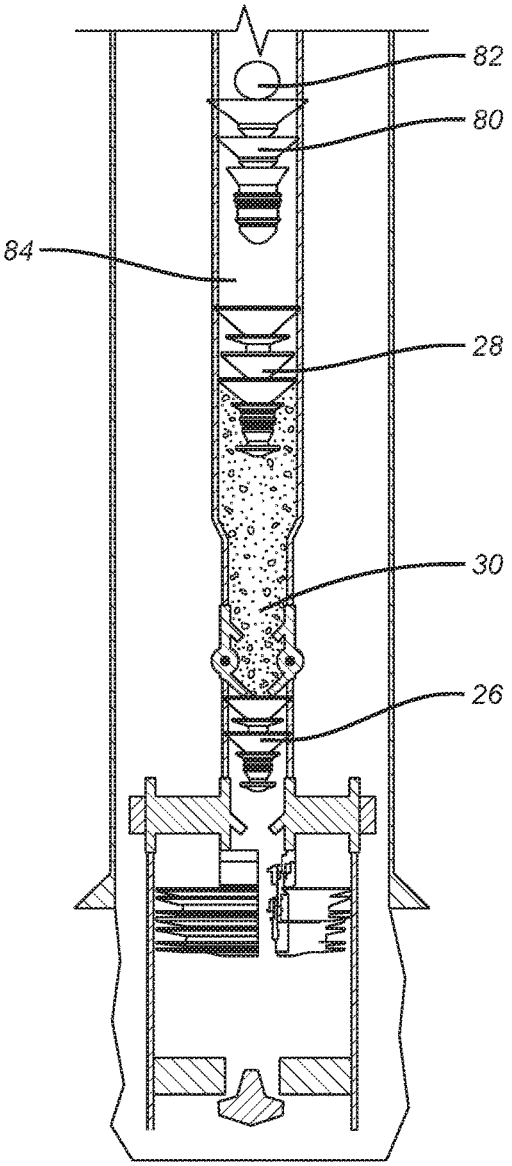
FIG. 24 is the view of FIG. 23 showing the bottom up cement delivered with a leading and trailing dart and a third dart delivered behind the cement.
Figure 25:
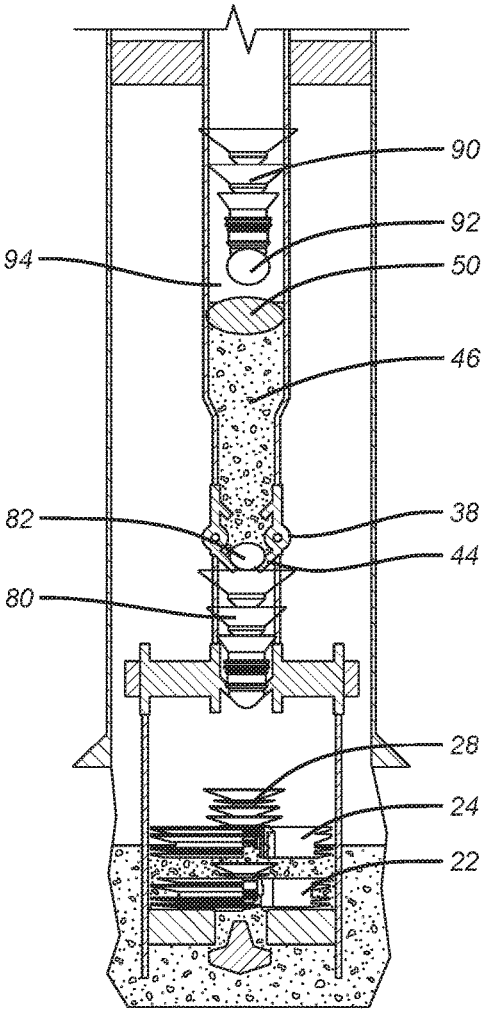
FIG. 25 is the view of FIG. 24 showing a dart behind the top down cement as the cement is delivered.
Figure 26:
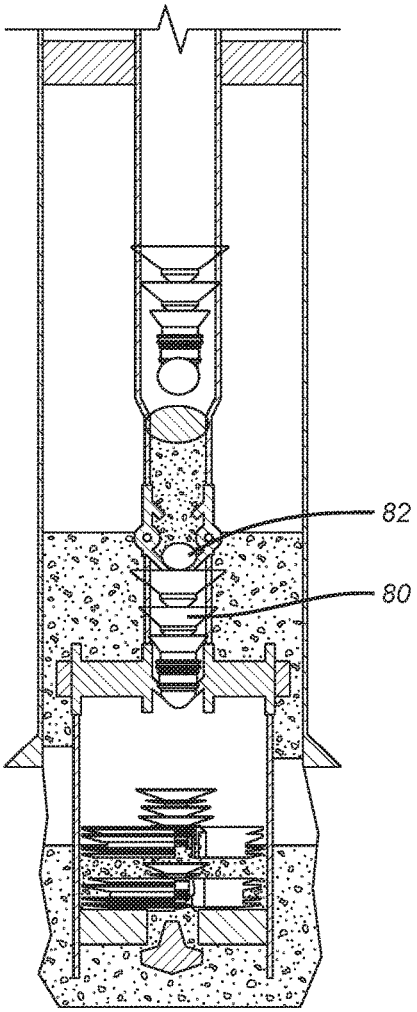
FIG. 26 is the view of FIG. 25 with the ported sub shifted open and the top down cement in the surrounding annular space.
Figure 27:
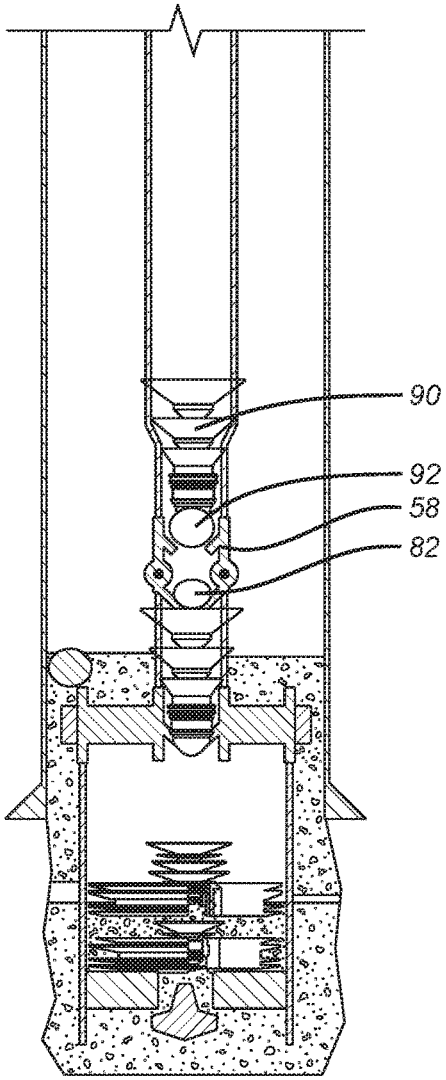
FIG. 27 is the view of FIG. 26 with the top down cement squeezed and the last dart landed in the ported sub with pressure applied above to close the ports of the ported sub.
Figure 28:
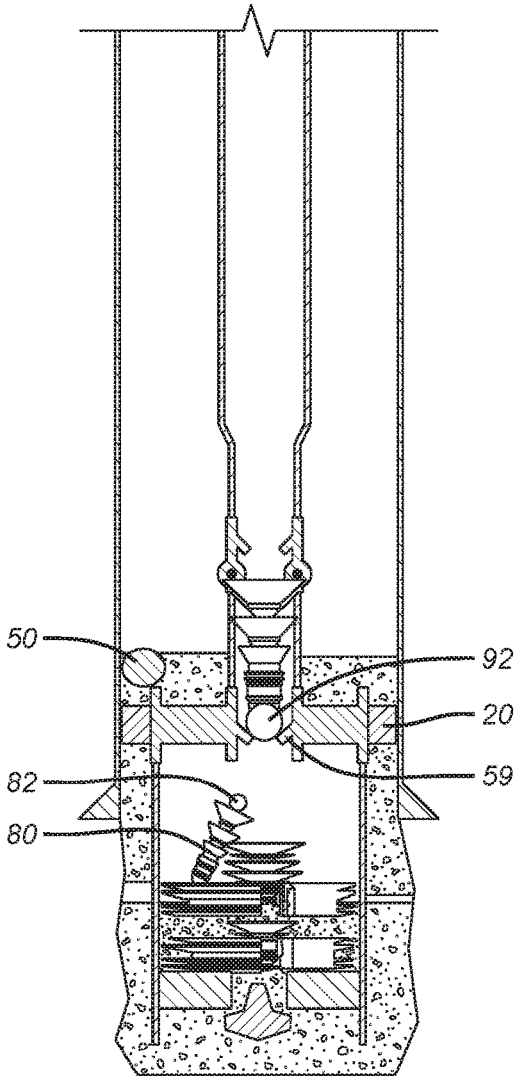
FIG. 28 is the view of FIG. 27 showing the third dart passing through the tools and the final dart's leading ball landing in the running tools for pressure setting the liner hanger/packer.
Figure 29:
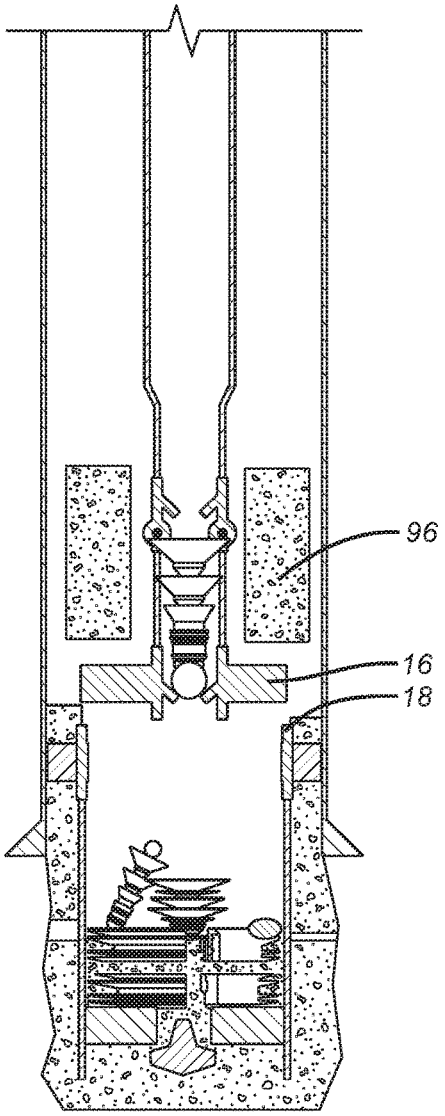
FIG. 29 is the view of FIG. 28 showing a release from the liner hanger/packer and reversing out excess cement.
Figure 30:
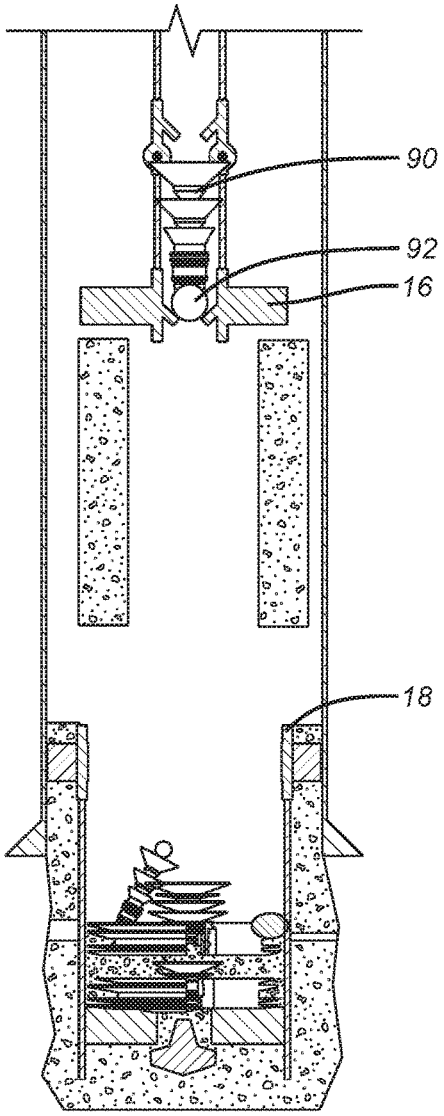
FIG. 30 is the view of FIG. 29 with the running tool being pulled out of the hole.

FIG. 23 is identical to FIG. 1. FIG. 24 differs from FIG. 2 in that a third dart 80 with a trailing ball 82 is delivered behind a spacer 84 along with bottom up cement 30 with its leading dart 26 and trailing dart 28. One difference from FIG. 3 is that the trailing dart 28 with wiper plug 24 do not necessarily bump on wiper plug 22. The dart 80 is stopped at seat 44 where applied pressure opens ports 38 to allow the top down cement 46 to enter annulus 40 as shown in FIG. 26. A fourth dart 90 has a leading ball 92 designed to land in seat 58 as shown in FIG. 27. The top down cement 46 can have a foam ball 50 behind it or several foam balls or none. A spacer can be located above the foam ball 50 or above the cement 46 itself and below leading ball 92. As before, the top down cement is squeezed around the slips and sealing element 20 of the liner hanger/packer 18 that at this point are not yet set. This is shown in FIG. 26. The leading ball 92 then lands in seat 92 after the squeeze job is over to allow closure of ports 38 in the ported sub 36. Further pressure is applied to move the fourth plug 90 with leading ball 92 seated on seat 58 so that ports 38 close followed by further movement of fourth dart 90 to land leading ball 92 on seat 59. At this point shown in FIG. 28 further pressure will simply set the liner hanger/packer 18 and release the running tool 16 to allow excess cement 96 to be circulated out as in FIG. 21 as opposed to reversing out as in FIG. 11. Third dart 80 is pushed through the running tool 16 as shown in FIG. 28. Ball 92 lands in seat 59 to set the liner hanger/packer 18 by extending the slips and sealing element 20 together or separately as discussed before, also as shown in FIG. 29. The tools are pulled from the hole in FIG. 30.

Those skilled in the art will appreciate that the time between the placing of the top down cement 46 and the setting of the liner hanger/packer 18 is cut down by at least several hours as the devices to close the ports 38 and set the liner hanger/packer 18 are delivered with the top down cement 46. In FIGS. 1-12 there was a need to wait for ball 56 to land on seat 58 and that ball was not delivered until after the squeeze cementing of the top down cement 46 was concluded. This can create a potential issue if the cement 46 sets before the liner hanger/packer 18 is set and the running tool 16 becomes impossible to remove.

Other options exist for operating the ported sub 36. It can be run in closed and triggered to open with a motor based on a signal delivered with the top down cement 46 such as with a sensed ingredient in the cement of a sonde that transmits a signal read by a sensor that controls the motor to open the ports 38. A timer can then be used to trigger the ports 38 to close. Alternatively a signal with the trailing dart 70 or 90 can signal the motor to close ports 38 so that pressure can be used to set the liner hanger/packer 18 and automatically release the running tool 16. Alternatively, a trailing foam ball such as 50 can contain a material to generate a signal to close ports 38 after a time long enough to squeeze all the cement 46.

The above description is illustrative of the preferred embodiment and many modifications may be made by those skilled in the art without departing from the invention whose scope is to be determined from the literal and equivalent scope of the claims below:

I claim:

1. A method of supporting and sealing a lower liner from an existing casing, comprising:

pumping a sealing material bottom up out a lower end of the lower liner and into a surrounding annular space after said lower liner is in an overlapping position with the existing casing with an unset liner hanger/packer in between;

pumping a sealing material top down from above said unset liner hanger/packer into said surrounding annular space;

providing a ported sub adjacent a liner hanger/packer through which said top down sealing material reaches said surrounding annular space;

closing said at least one port in said ported sub as said top down sealing material is squeezed through using at least one object delivered on a dart;

providing a plurality of objects as said at least one object;

operating at least one port in said ported sub open and closed with delivered said objects through a running string connected to said ported sub.

2. The method of claim 1, comprising:

minimizing time between closing said at least one port and setting said liner hanger/packer by said delivering of said objects with said top down sealing material.

3. The method of claim 1, comprising:

making said objects spheres of different sizes sequentially landing on spaced seats for opening and then closing said at least one port.

4. The method of claim 3, comprising:

delivering a larger of said spheres after squeezing said top down sealing material into said surrounding annular space.

5. The method of claim 1, comprising:

delivering a first said object ahead of said top down sealing material and a second said object with and behind said top down sealing material.

6. The method of claim 5, comprising:

minimizing time between closing said at least one port and setting said liner hanger/packer by said delivering of said first and second objects with said top down sealing material.

7. The method of claim 5, comprising:

displacing said first object from said ported sub during movement of said second object as said second object closes at least one port.

8. The method of claim 7, comprising:

landing said first object on a seat of a running tool for said liner hanger/packer after said first object exits said ported sub.

9. The method of claim 5, comprising:

providing as said second object said dart with a leading ball;

landing said leading ball on a closing seat in said ported sub;

moving said closing seat with pressure to close said at least one port.

10. The method of claim 9, comprising:

providing a sphere as said first object;

displacing said sphere from a seat on an opening sleeve for said at least one port when said dart is passing through said closing seat in said ported sub.

11. The method of claim 10, comprising:

landing said sphere on a seat of a running tool for said liner hanger packer after said sphere exits said ported sub.

12. The method of claim 11, comprising:

stopping said dart on said seat on said running tool;

releasing said running tool from said liner hanger/packer after setting said liner hanger/packer with said sphere on said seat.

13. The method of claim 5, comprising:

closing said at least one port with said second object.

14. The method of claim 13, comprising:

providing said dart with a leading ball as said second object;

sequentially landing said leading ball on a closing seat for said at least one port to close said at least one port followed by landing said leading ball on a setting seat on a running tool for pressure setting said liner hanger/packer.

15. The method of claim 14, comprising:

providing said dart with a trailing ball as said first object;

landing said trailing ball on an opening sleeve seat for said at least one port to open said at least one port.

16. The method of claim 15, comprising:

pushing said dart with a trailing ball out through said ported sub and then through said setting seat on said running tool for said liner hanger/packer.

17. The method of claim 14, comprising:

retaining said running tool with the leading ball on said seat on said running tool as said running tool is released from a set said liner hanger/packer;

removing said running tool with said dart with a trailing ball together with a running string.

* * * * *